US010638904B2

(12) United States Patent
Kleine-Doepke et al.

(10) Patent No.: US 10,638,904 B2
(45) Date of Patent: May 5, 2020

(54) VACUUM CLEANER NOZZLE HAVING ROTATABLE BRUSH

(71) Applicant: KONINKLIJKE PHILIPS N.V., Eindhoven (NL)

(72) Inventors: Bastian Cornelis Kleine-Doepke, Zuidhorn (NL); Paul Van Der Wal, Rottevalle (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/336,734

(22) PCT Filed: Feb. 12, 2018

(86) PCT No.: PCT/EP2018/053436
§ 371 (c)(1),
(2) Date: Mar. 26, 2019

(87) PCT Pub. No.: WO2018/149786
PCT Pub. Date: Aug. 23, 2018

(65) Prior Publication Data

US 2019/0357746 A1 Nov. 28, 2019

(30) Foreign Application Priority Data

Feb. 20, 2017 (EP) ..... 17156931

(51) Int. Cl.
*A47L 9/28* (2006.01)
*A46B 15/00* (2006.01)
(Continued)

(52) U.S. Cl.
CPC ..... *A47L 9/2836* (2013.01); *A46B 15/0036* (2013.01); *A47L 9/0477* (2013.01); *A47L 9/2831* (2013.01); *A47L 9/30* (2013.01)

(58) Field of Classification Search
CPC ..... A47L 9/30; A47L 9/28; A47L 5/30; A47L 9/2857; A47L 9/2842; A47L 9/2889;
(Continued)

(56) References Cited

U.S. PATENT DOCUMENTS 3,253,295 A 5/1966 Waters
4,728,942 A * 3/1988 England ..... A47L 9/2842 15/339
(Continued)

FOREIGN PATENT DOCUMENTS

CN 201481320 U 5/2010
CN 205671980 U 11/2016
(Continued)

*Primary Examiner* — Robert J Scruggs

(57) ABSTRACT

A vacuum cleaner nozzle (N) comprising a rotatable brush (B) having a light distribution mechanism for distributing light from the rotatable brush (B), a transparent screen (S) through which a user can see the rotatable brush (B), and a drive unit for rotating the rotatable brush (B). The light distribution mechanism may have a plurality of lighting positions (L) on the rotatable brush (B). The light distribution mechanism may have a plurality of light sources distributed over a surface of the rotatable brush (B). The light distribution mechanism may have a light guide (LG) inside the rotatable brush (B), from which light escapes at the plurality of lighting positions (L), and may further have a light source (LED) for applying light to the light guide (LG). Alternatively, the light distribution mechanism has a plurality of mirrors at the lighting positions (L). The vacuum cleaner nozzle (N) may further have a sensor for measuring a rotation speed of the rotatable brush (B), and a controller for controlling the light distributed from the rotatable brush (B) in dependence on the rotation speed. The vacuum cleaner nozzle (N) can be applied in a vacuum cleaner further having a dirt collecting unit for collecting dirt.

9 Claims, 1 Drawing Sheet

(51) Int. Cl.
*A47L 9/04* (2006.01)
*A47L 9/30* (2006.01)

(58) Field of Classification Search
CPC .... A47L 9/2836; A47L 9/0477; A47L 9/2831; A46B 15/0036
See application file for complete search history.

(56) References Cited

U.S. PATENT DOCUMENTS

| | | | | |
|---|---|---|---|---|
| 5,467,501 | A * | 11/1995 | Sepke | A47L 9/2847 15/324 |
| 6,289,552 | B1 * | 9/2001 | McCormick | A47L 5/30 15/324 |
| 2002/0201730 | | 8/2002 | Dilger | |
| 2003/0059738 | A1 | 3/2003 | Neuberger | |
| 2004/0147984 | A1 | 7/2004 | Altshuler et al. | |
| 2005/0055655 | A1 | 3/2005 | Anderson | |
| 2008/0131834 | A1 | 6/2008 | Shepherd | |
| 2009/0177125 | A1 * | 7/2009 | Pilcher | A46B 15/0034 601/18 |
| 2015/0327742 | A1 * | 11/2015 | Strang | A47L 11/4011 15/49.1 |

FOREIGN PATENT DOCUMENTS

| | | | |
|---|---|---|---|
| JP | 2005124861 | A | 5/2005 |
| WO | 2009105698 | A1 | 8/2009 |
| WO | 2013132369 | A1 | 9/2013 |

* cited by examiner

VACUUM CLEANER NOZZLE HAVING ROTATABLE BRUSH

This application is the U.S. National Phase application under 35 U.S.C. § 371 of International Application No. PCT/EP2018/053436, filed on Feb. 12, 2018, which claims the benefit of International Application No. 17156931.2, filed Feb. 20, 2017. These applications are hereby incorporated by reference herein.

FIELD OF THE INVENTION

The invention relates to a vacuum cleaner nozzle having a rotatable brush, and to a vacuum cleaner provided with the vacuum cleaner nozzle.

BACKGROUND OF THE INVENTION

U.S. Pat. No. 6,289,552 discloses a vacuum cleaner including a housing having a nozzle that incorporates an agitator cavity. A rotary agitator is received in the agitator cavity. A light source is held in an illumination compartment carried on the housing. A first window divides the illumination compartment from the agitator cavity and a second window provides an outer facing for the illumination compartment. The light source illuminates the agitator which is viewed through the first and second windows.

U.S. Pat. No. 5,467,501 discloses a vacuum cleaner having a transparent belt view window formed in the vacuum cleaner hood to allow the operator to observe the operating condition of the belt therein, the belt being operable to transfer rotational motion from a motor output shaft to a rotary brush. The belt may include a pattern of markings allowing the user to distinguish between rotating and non-rotating operating conditions.

SUMMARY OF THE INVENTION

The inventors have realized that the prior art vacuum cleaner nozzles suffer from disadvantages. In vacuum cleaner nozzles with a rotating brush roll, the speed of rotation of the rotatable brush is so fast that the user can hardly notice the rotation. Because of this, the user is also unable to see if the rotatable brush is polluted. The pollution occurs when strands of textile, human or pet hair among other items roll and attach to the rotatable brush core. Also, these items get inside the tufts (flexible plastic brush hairs) of the rotatable brush and hinder the cleaning ability. As the user is unable to see this pollution happening, the user continues to use the appliance but with a degraded performance level as pollution is too high or the rotatable brush roll has completely stopped rotating. Being able to see markings on a drive belt does not yet allow a user to monitor whether the rotatable brush is polluted.

It is, inter alia, an object of the invention to provide an improved vacuum cleaner nozzle having a rotatable brush which allows users to monitor whether the rotatable brush is moving and/or polluted. The invention is defined by the independent claims. Advantageous embodiments are defined in the dependent claims.

In accordance with an aspect of the invention, light is distributed from the rotatable brush. In this way, a user can not only monitor whether the rotatable brush rotates but also whether it is polluted.

An embodiment of the invention provides a rotating brush in a vacuum cleaner nozzle that has a light guiding transparent core and light guide elements that guide the light from the core to the surface of the rotatable brush role enabling the light to radiate in the ambient. Light is generated by a static positioned LED that is shining into the rotating core of the rotatable brush. The emitted light gives indication to users about speed of brush rotation and pollution state of the rotatable brush. Another useful aspect is that the customer can clean the rotatable brush more frequently as little pollution (which is easy to clean) is easily noticeable. Also, the user can by noticing the active brush rotation more easily identify the different power settings the rotatable brush is rotating at.

These and other aspects of the invention will be apparent from and elucidated with reference to the embodiments described hereinafter.

DESCRIPTION OF EMBODIMENTS

Figure 1:
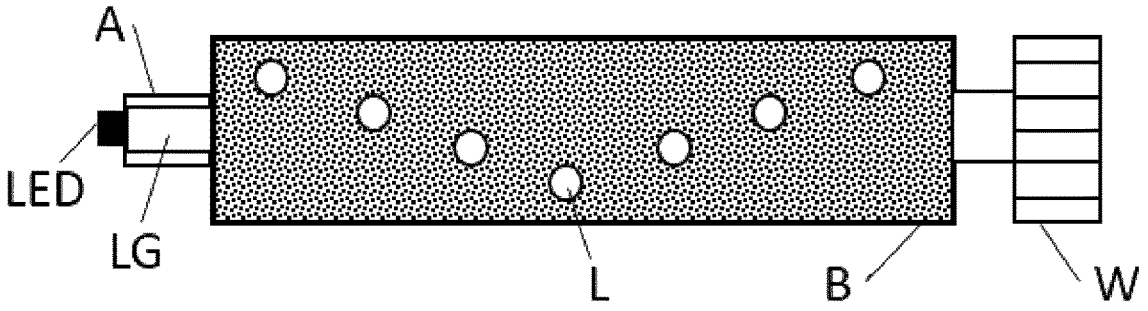
FIG. 1 shows a first embodiment of a rotatable brush for use in a vacuum cleaner nozzle in accordance with the invention.

A first embodiment of a rotatable brush for use in a vacuum cleaner nozzle in accordance with the invention is shown in FIG. 1. The rotation around an axis A is caused by a motor which is connected to the rotatable brush B by way of gears or pulley that drive a wheel W. The rotatable brush B has a transparent light conducting material in its core that acts as a light guide LG. Further, the core has radially placed holes or light guides in the core in order to guide the light from the core to the outer part of the rotatable brush roll where it can radiate to the ambience via a plurality of openings L. Further, one or more LEDs are positioned in the vacuum cleaner nozzle in such a place that the LED does not rotate but shines light in axial direction into the transparent core of the rotatable brush B. The LED is therefore positioned in a static part of the vacuum cleaner nozzle, and the LED is thus not vulnerable to high rotation speed or pollution of connection. Also, as the LED is in a static part, no expensive sliding contacts are needed to apply power to the LED.

Additionally, if we measure the rotational position of the rotatable brush B including the position of the holes for light guidance, the LED can be pulsed electronically in such a way that it enables creating patterns to indicate the speed level of the rotatable brush to the consumers. The position of the holes or light guides can be measured by position sensors known in the art. To this end, a magnet can be placed on the wheel W, while a static part of the vacuum cleaner nozzle comprising the rotatable brush B comprises a Hall effect sensor adjacent to the wheel W. This Hall effect sensor provides a pulse each time that the magnet on the wheel W passes the Hall effect sensor.

As mentioned above, in case of pollution around the rotatable brush roll with hairs etc., the light from the rotatable brush is gradually blocked by the polluting materials and thus no light can be seen from them. This will give a clear indication to the consumer that the rotatable brush B is polluted and needs to be cleaned. Time between the pulses give indication on rotating speed. Based on this speed, the rotation position of the rotatable brush can be calculated. Alternatively, a rotation position sensor could be used, like the Agilent AEDB-9140.

Also, by varying the speed, the position sensor gives a varying signal to the LED to enable pattern creation that highlight the speed of rotation.

In this way, the invention allows a user to notice 1. that the rotatable brush is rotating, and also whether the rotatable brush stops rotating due to a blockage
2. that the rotatable brush is polluted as soon as it begins to pollute
3. the speed of rotation so that power settings can be set accordingly and power conserved easily.

Figure 2:
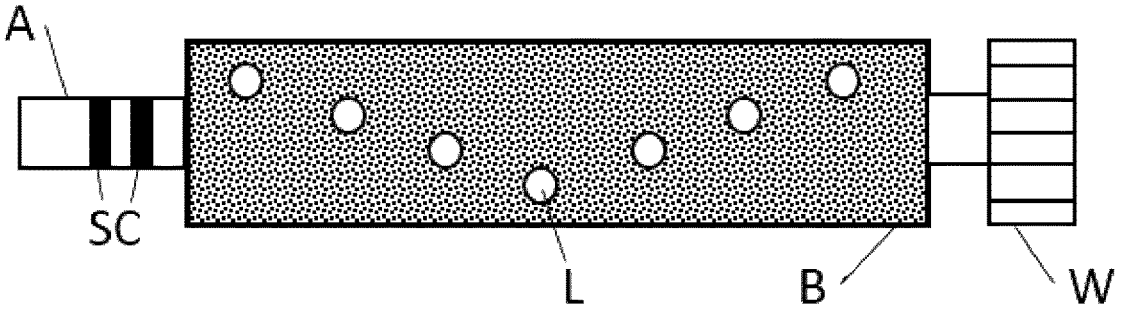
FIG. 2 shows a second embodiment of a rotatable brush for use in a vacuum cleaner nozzle in accordance with the invention.

FIG. 2 shows a second embodiment of a rotatable brush for use in a vacuum cleaner nozzle in accordance with the invention. This embodiment differs from that of FIG. 1 in that the axis A is provided with sliding contacts SC by means of which electrical energy can be transmitted to the rotatable brush B. In this way, it is possible to power an LED in the rotatable brush B that applies light to a light guide from which light escapes at the plurality of openings L. Alternatively, at each of these openings L a separate LED is provided.

Figure 3:
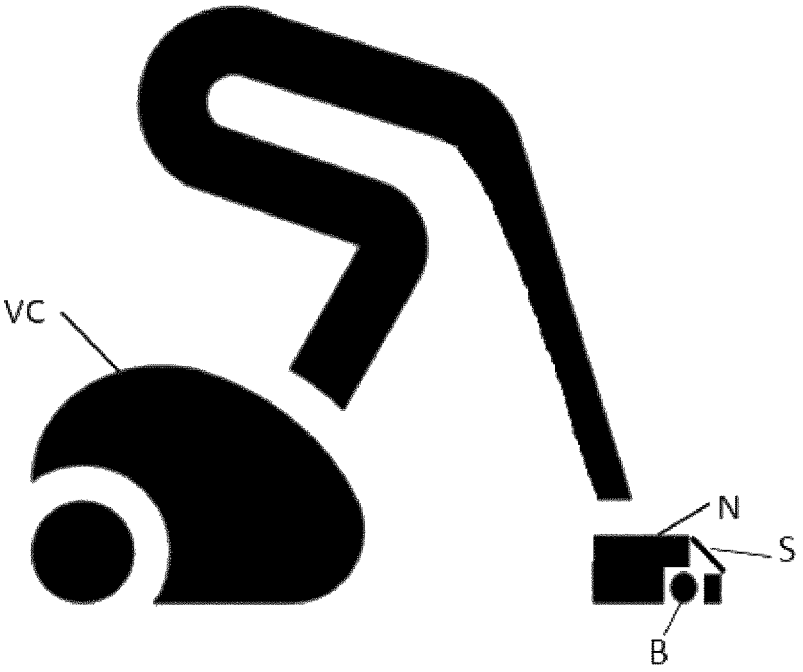
FIG. 3 shows an embodiment of a vacuum cleaner comprising a vacuum cleaner nozzle in accordance with the invention.

FIG. 3 shows an embodiment of a vacuum cleaner VC comprising a vacuum cleaner nozzle N having a rotatable brush B in accordance with the invention. The vacuum cleaner nozzle N has a transparent screen S through which a user can see the rotatable brush B. If the rotatable brush B rotates, the user will see the rotating lights from the rotatable brush B through the screen S. The vacuum cleaner nozzle N comprises a drive unit to make the rotatable brush B rotate. The drive unit may be formed by e.g. a motor or a turbo brush execution which uses the intake air to drive the rotatable brush B. As usual, the rotatable brush B may be suspended at both ends in the nozzle N. As usual, the vacuum cleaner VC has a dirt collection unit for collecting dirt. The vacuum cleaner VC may be a bagless vacuum cleaner that separates dirt from air by means of a cyclone, or a more classical vacuum cleaner having a bag to collect the dirt. While FIG. 3 shows a vacuum cleaner VC having a canister, the invention can alternatively be applied to a stick-formed vacuum cleaner or a robot vacuum cleaner or a handheld vacuum cleaner.

Aspects of the invention can be summarized as follows. A vacuum cleaner nozzle N comprises a rotatable brush B having a light distribution mechanism for distributing light from the rotatable brush B, a transparent screen S through which a user can see the rotatable brush B, and a drive unit for rotating the rotatable brush B. The light distribution mechanism may have a plurality of lighting positions L on the rotatable brush B. The light distribution mechanism may have a plurality of light sources distributed over a surface of the rotatable brush B. The light distribution mechanism may have a light guide LG inside the rotatable brush B, from which light escapes at the plurality of lighting positions L, and may further have a light source LED for applying light to the light guide LG. Alternatively, the light distribution mechanism has a plurality of mirrors at the lighting positions L, which mirrors reflect light shining on the rotatable brush B (unless the light is obscured by dirt). The vacuum cleaner nozzle N may further have a sensor for measuring a rotation speed of the rotatable brush B, and a controller for controlling the light distributed from the rotatable brush B in dependence on the rotation speed. The vacuum cleaner nozzle N can be applied in a vacuum cleaner VC further having a dirt collecting unit for collecting dirt.

It should be noted that the above-mentioned embodiments illustrate rather than limit the invention, and that those skilled in the art will be able to design many alternative embodiments without departing from the scope of the appended claims. For example, the light distribution mechanism on the rotatable brush may comprise a plurality of mirrors at the lighting positions, which are illuminated by a light source (e.g. one or more LEDs) in the vacuum cleaner nozzle housing. Instead of from a plurality of lighting positions L on the rotatable brush B as shown in the drawings, the light may alternatively come from a single zig-zag or V-shaped or helical strip on the brush bar. As an alternative to a non-transparent brush core having a light guide inside from which light escapes through openings in the non-transparent brush core, it is possible to have a (for example, transparent) brush core that itself acts as the light distribution mechanism. The light distribution system may be implemented by light escaping through a subset of the tufts of the rotatable brush, which subset of tufts may be formed by optical fibers. In a configuration with a light source inside the rotatable brush, sliding contacts are not needed to power the light source if the brush is provided with a battery. Instead of LEDs, other light sources may be used, such as lasers. The notion "brush" covers not only brushes formed by tufts of hair or some kind of stiff material on the core, but also all other forms of agitators capable of releasing dirt from a surface. As described above, the vacuum cleaner nozzle may comprise a sensor for measuring a rotation speed of the rotatable brush B, and a controller for controlling the light distributed from the rotatable brush B in dependence on the rotation speed. This controller may control the light further in dependence on other sensor signals, e.g. from a dust sensor, thereby allowing to provide more feedback to the user e.g. by means of mutually different light patterns. In the claims, any reference signs placed between parentheses shall not be construed as limiting the claim. The word "comprising" does not exclude the presence of elements or steps other than those listed in a claim. In addition to a rotatable brush having a core from which light shines, a vacuum cleaner may have one or more other brushes without this light feature. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A vacuum cleaner nozzle comprising:

a rotatable brush comprising a light distribution mechanism for distributing light from the rotatable brush;

a transparent screen through which a user can see the rotatable brush; and a drive unit for rotating the rotatable brush;

wherein a sensor for measuring a rotation speed of the rotatable brush, and a controller for controlling the light distributed from the rotatable brush in dependence on the rotation speed of the rotatable brush.

2. A vacuum cleaner nozzle as claimed in claim 1, wherein the light distribution mechanism includes a plurality of lighting positions on the rotatable brush.

3. A vacuum cleaner nozzle as claimed in claim 2, wherein the light distribution mechanism includes a plurality of light sources distributed over a surface of the rotatable brush.

4. A vacuum cleaner nozzle as claimed in claim 2, wherein the light distribution mechanism includes a light guide inside the rotatable brush, from which light escapes at the plurality of lighting positions.

5. A vacuum cleaner nozzle as claimed in claim 4, further comprising a light source for applying light to the light guide.

6. A vacuum cleaner nozzle as claimed in claim 2, wherein the light distribution mechanism includes a plurality of mirrors at the lighting positions.

7. A vacuum cleaner nozzle as claimed in claim 1, further comprising a dust sensor, and the controller is further arranged for controlling the light distributed from the rotatable brush in dependence on the dust.

8. Vacuum cleaner comprising:

a vacuum cleaner nozzle as claimed in claim 1, and a dirt collecting unit for collecting dirt.

9. A vacuum cleaner nozzle as claimed in claim 1, wherein the sensor for measuring the rotation speed of the rotatable brush comprises a sensor for measuring a rotational position of the rotatable brush.

* * * * *